United States Patent [19]

Gulsby

[11] 4,251,249

[45] Feb. 17, 1981

[54] LOW TEMPERATURE PROCESS FOR SEPARATING PROPANE AND HEAVIER HYDROCARBONS FROM A NATURAL GAS STREAM

[75] Inventor: Jerry G. Gulsby, Humble, Tex.

[73] Assignee: The Randall Corporation, Houston, Tex.

[21] Appl. No.: 969,990

[22] Filed: Dec. 15, 1978

Related U.S. Application Data

[63] Continuation of Ser. No. 760,515, Feb. 19, 1977, abandoned.

[51] Int. Cl.[3] ..... F25J 3/02

[52] U.S. Cl. ..... 62/28; 62/38

[58] Field of Search ..... 62/23–28, 62/38, 39, 42

[56] References Cited

U.S. PATENT DOCUMENTS

| | | | |
|---|---|---|---|
| 2,645,104 | 7/1953 | Kniel | 62/26 |
| 3,274,787 | 9/1966 | Grenier et al. | 62/23 |
| 3,397,138 | 8/1968 | Bacon | 62/39 |
| 3,516,262 | 6/1970 | Bernstein | 62/28 |
| 3,589,137 | 6/1971 | Hoffman | 62/39 |
| 3,797,261 | 3/1974 | Juncker et al. | 62/28 |
| 4,061,481 | 12/1977 | Campbell et al. | 62/38 |

*Primary Examiner*—Norman Yudkoff

*Attorney, Agent, or Firm*—Arnold, White & Durkee

[57] ABSTRACT

A process for low temperature fractionation of natural gas to recover as product propane and the heavier hydrocarbons with an efficiency of 90% or greater and an ethane content rejection of 90% or more. The process includes passage of the natural gas through several refrigeration zones followed by a first separation stage to separate liquid condensate from $C_1$, $C_2$ and $C_3$ hydrocarbon gas. The gas stream is cooled further by expansion followed by a second separation stage to separate liquid containing $C_1$, $C_2$ and $C_3$ hydrocarbons from the gas which contains only $C_1$ and $C_2$ hydrocarbons. Both streams are fed to a de-ethanizer fractionating column, with the liquid entering at a point intermediate the ends and the gas being utilized in a reflux condenser internal to the column above the point of entry of the liquid stream. Employment of the low temperature $C_1$, $C_2$ hydrocarbon gas in a reflux condenser in the column provides the necessary refrigeration to condense the propane and heavier constituents of the inlet gas and reject the methane and ethane.

8 Claims, 1 Drawing Figure

LOW TEMPERATURE PROCESS FOR SEPARATING PROPANE AND HEAVIER HYDROCARBONS FROM A NATURAL GAS STREAM

This is a continuation of application, Ser. No. 760,515, filed Jan. 19, 1977, now abandoned.

BACKGROUND AND PRIOR ART

The present invention relates to a method and apparatus for removing condensable components from hydrocarbon gas; and more particularly, the invention relates to a low temperature fractioning process for removing propane and heavier hydrocarbons from natural gas.

There are a number of processes in the prior art relating to the rejection of methane and ethane from natural gas to recover the heavier fractions, i.e., LPG and the natural gasoline components. These processes, however, are of limited efficiency with only about 65% to 70% of the propane content of the natural gas being recoverable when substantial percentages of the ethane content is rejected.

In a conventional method of recovering propane and the heavier fractions from natural gas, the natural gas is cryogenically processed by refrigerating the gas to a low temperature to effect a greater separation of the propane and heavier components from the natural gas stream. It is, however, expensive to produce refrigeration; and the deeper the refrigeration that is needed, the more expensive it becomes to process the gas. This is particularly so since the increase in expense with respect to the depth of refrigeration is not a linear function, but increases at an increasing rate of change.

To achieve a high efficiency of separation of propane from a natural gas stream, it is necessary to attain a temperature of about −60° F. To produce this low temperature, a refrigeration mechanism is needed utilizing a refrigerant capable of attaining this low temperature. Common refrigerants in use include freon and propane. Freon, though a very desirable refrigerant, is very expensive, and its use in quantities such as would be required in a refrigeration system capable of cooling a large volume of gas to −60° F. would be prohibitively expensive in the application of natural gas processing to recover propane. Propane, though less expensive than freon, is limited in its use to those situations where the temperature need not be taken below about −40° F. In order to utilize propane as the primary refrigerant to attain −60° F., it is necessary to place the propane under a vacuum. This type of operation does, however, present a danger of explosion in the event an air leak develops in the system, as propane in the presence of air can create an explosive mixture.

Accordingly, conventional refrigeration techniques for recovering propane from natural gas have been in most market situations too expensive to use. Also, even where such techniques have been utilized, the propane recovery efficiency has been low, on the order of 75%, with 30%-40% of the ethane content being retained also.

Another process in the prior art for recovering propane from natural gas is that disclosed in U.S. Pat. No. 3,292,380 issued Dec. 20, 1966. In that process, natural gas under pressure is pre-cooled and expanded through a turbine to produce a gas-condensate mixture at a low temperature. This mixture is then fed to a separator where the liquids, LPG and heavier hydrocarbons including the natural gasolines, are separated from the gas, methane and ethane. This process may be carried out to achieve greater recovery of propane, such as about 90%; but there is a concomitant increase in the amount of ethane in the product to the extent of about 35% to 40% of the ethane content in the inlet gas stream.

Another process in the prior art for separating propane from a natural gas stream, and one with which a propane recovery efficiency of approximately 90% with high ethane rejection can be achieved, is that wherein a conventional turbo-expander plant is first utilized to reject the methane content of the natural gas stream, thereby yielding a high ethane and heavier hydrocarbon component recovery from the stream. The ethane and heavier component recovery products are then fed to a de-ethanizer to reject a large portion of the ethane, leaving substantially only the propane and heavier gasoline components.

Although refrigeration equipment is needed in this process, the de-ethanization may be carried out at +60° F. rather than −60° F. But, the expense involved in providing the two stage process is significant. As well as the additional equipment that is required for such a two stage process, i.e., extra tower and extra instrumentation, the maintenance necessary to keep the plant running and avoid costly down time is great.

In addition to the above techniques and processes for separating propane and heavier hydrocarbons from a natural gas stream, yet another low temperature process using a turbo-expander is described in U.S. Pat. No. 2,601,009 issued June 17, 1952. In this process, inlet natural gas is pre-cooled to a temperature below 0° F. and fed to a separator where the condensed liquids accumulate at the bottom of the separator and the gas is brought out of the top of the tower. The gas is passed through an expander to cool the gas, and it is thereafter applied to a reflux condenser the upper end of the separator tower. This step has the effect of condensing the heavier hydrocarbon components to yield greater recovery thereof. Afterward, the de-propanized gas is compressed and supplied to a pipeline. This process, though covering 95% to 97% of the propane content of the inlet natural gas stream, also has in the compressed gas outlet stream approximately 50% of the ethane content of the inlet natural gas.

Although several processes have been proposed in the past for the separation of propane and heavier hydrocarbons from a natural gas stream, the processes have not found widespread utilization due to the significant expense attendant their implementation, or because there is a low propane recovery efficiency where a high rejection of ethane is attained. Accordingly, it would be desirable to have a process for the separation of propane and heavier hydrocarbons from a natural gas stream wherein only a slight percentage of the propane content of the inlet natural gas stream is lost in a separation that rejects substantially all the ethane content of the natural gas stream.

SUMMARY OF THE INVENTION

The present invention provides a low temperature fractioning process for the efficient separation of condensable components from a hydrocarbon gas stream containing methane, ethane, propane and heavier hydrocarbon components. In particular, the present invention provides a low temperature process for the separation of propane and the heavier components of a natural gas stream. With the process of the instant invention a high efficiency of propane recovery is achieved, along with a rejection of substantially all the ethane content of the inlet gas stream.

Accordingly, it is a primary feature of this invention to provide a process that recovers as product 90% or more of the propane content of an inlet natural gas stream and rejects 90% or more of the ethane content of the inlet gas stream.

It is another feature of the invention to provide a process that achieves the foregoing degree of propane recovery efficiency, while producing only a minimum reduction in pressure through the process plant from the feed gas pressure at the inlet.

In accordance with the present invention, and to attain the above-recited features, the methane and ethane content of the inlet gas stream is utilized in a reflux condenser to effect low temperature separation of propane from gas containing ethane in the presence of methane. In this manner, the invention achieves the desired efficiency of propane separation recovery and ethane rejection in a single stage process, avoiding the expense attendant the two stage process of demethanization followed by de-ethanization, and the danger of explosion associated with the employment of propane as a refrigerant in conventional low temperature propane fractionation processes.

In terms of the general overall process of the present invention for the low temperature separation of propane from hydrocarbon gas containing methane and ethane, the process generally involves, after dehydration, passing the inlet gas successively through a series of refrigeration zones, for example heat exchangers, leading to an initial separation wherein there is a removal of a liquid stream containing $C_1$, $C_2$, $C_3$ and heavier hydrocarbons to effectively deplete the gas of isobutane and heavier hydrocarbons. The cooled gas that remains is expanded through a turbine to produce a low temperature gas-condensate mixture that is applied to a second stage of separation wherein the $C_1$, $C_2$ and $C_3$ hydrocarbon condensate is separated from the gas which is predominantly methane and ethane. The $C_1$ to $C_3$ hydrocarbon condensate is introduced into a fractionating column at a point intermediate the ends thereof, and the gas is sent to a reflux condenser disposed in the upper end of the fractionating column. In addition, the liquid stream from the initial separation stage, after passage through one of the refrigeration zones in which it becomes heated effecting a partial reboil of the methane and ethane contained therein, is introduced into the fractionating column at a point beneath the point of entry of the $C_1$ to $C_3$ hydrocarbon condensate to strip methane and ethane from the condensate with its vapor. After passage through the reflux condensor, the methane and ethane gas is combined with that rejected out the top of the fractionating column. Propane and the heavier hydrocarbon fractions, including the natural gasolines, accumulate in the bottom of the fractionating column as liquid, and are drawn off as product.

In another aspect of the process, the de-ethanizer is provided with a reboiler to heat liquid drawn from the fractionating column to drive off any remaining methane and ethane. The reboiler can be in the form of a heat exchanger, with the heat for reboiling being derived from recompressed residue gas of the process.

The instant invention is concerned primarily with and is characterized by the second stage $C_1$ to $C_3$ hydrocarbon condensate separation from the $C_1$ and $C_2$ gas and the utilization of that gas in the reflux condenser to provide the high efficiency low temperature fractioning of propane.

The apparatus of the instant invention for carrying out the process comprises a refrigeration unit for cooling the inlet hydrocarbon gas and a first separator for deriving a cooled gas stream containing $C_1$, $C_2$ and $C_3$ hydrocarbons. It also comprises a gas expander for further cooling the gas stream to provide a gas-condensate mixture and a second separator for deriving a $C_1$ to $C_3$ hydrocarbon liquid stream and a $C_1$ and $C_2$ gas stream. A de-ethanizer fractionating column is included having an inlet for the $C_1$ to $C_3$ liquid stream intermediate its ends and a reflux condenser disposed internally thereof above the liquid inlet. The reflux condenser receives the cooled $C_1$, $C_2$ gas stream from the second separator and serves to condense propane from the liquid stream and reject methane and ethane. The column has an outlet at the lower end through which accumulated liquid propane can be drawn off and an outlet at the upper end through which rejected methane and ethane gas can be withdrawn.

These and other features of the instant invention, as well as the details of an illustrative embodiment thereof, will be understood more fully from the following description of the accompanying process flow sheet diagram of FIG. 1.

DESCRIPTION OF THE PREFERRED EMBODIMENT

Figure 1:
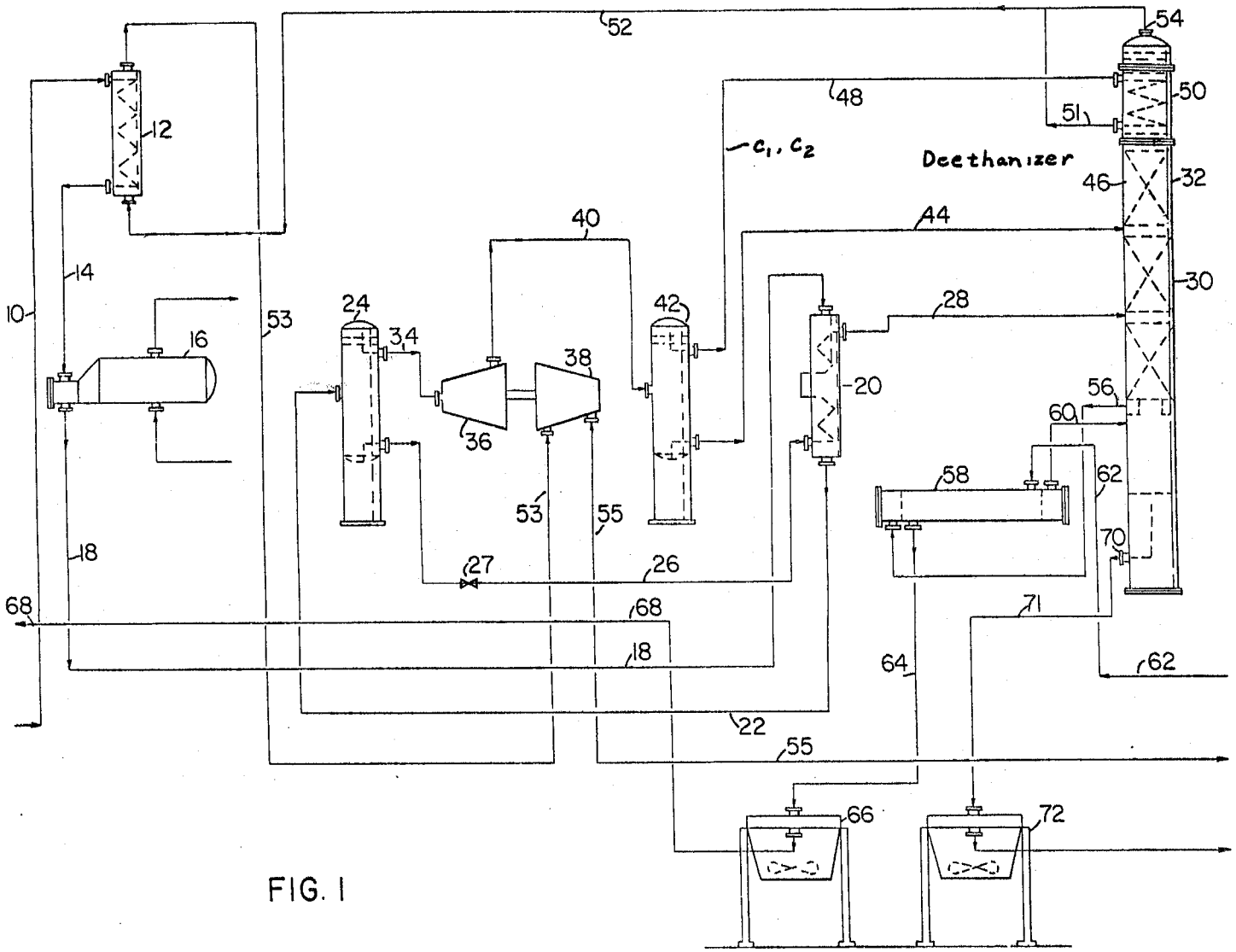
Figure 1A:
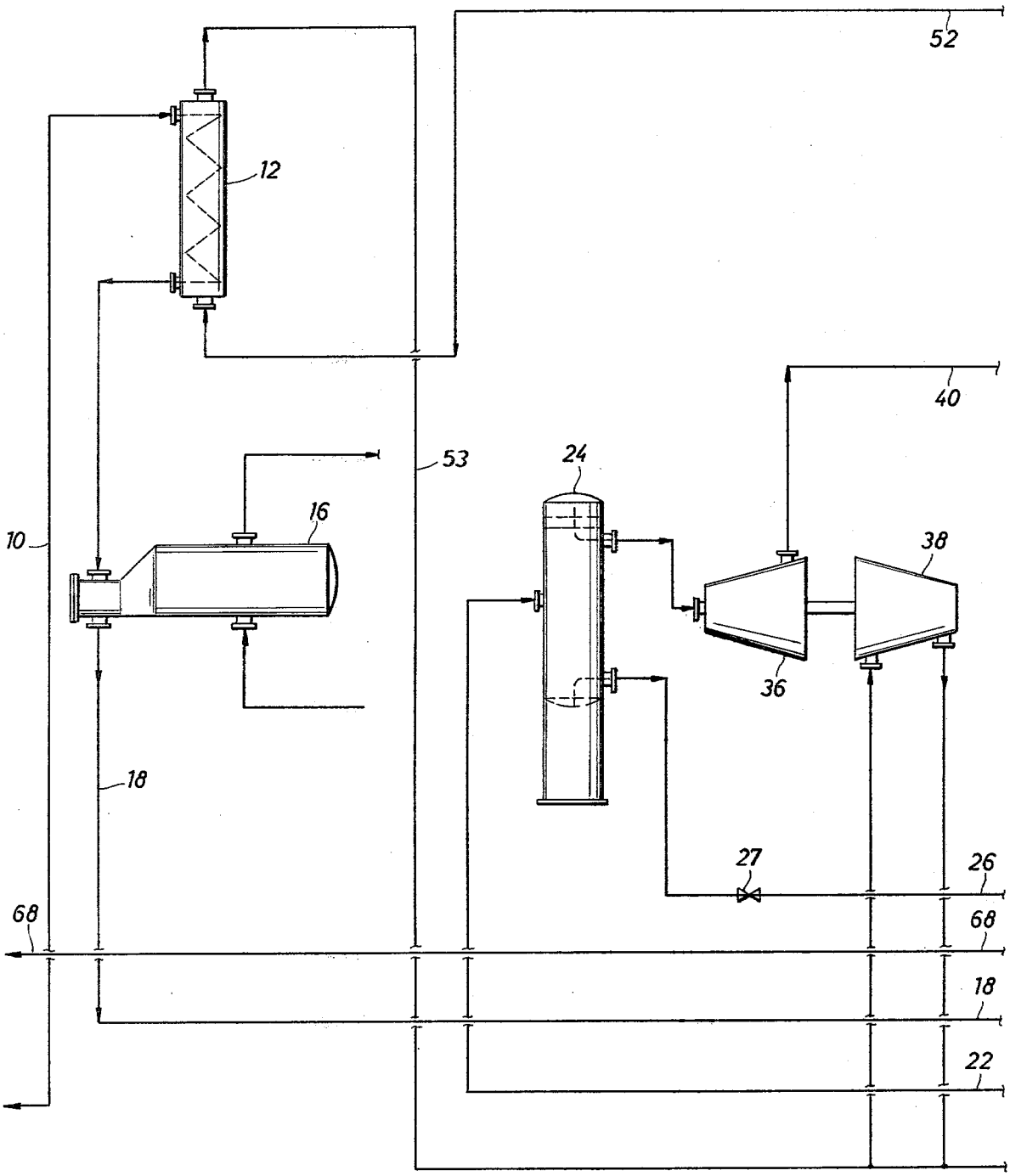
Figure 1B:
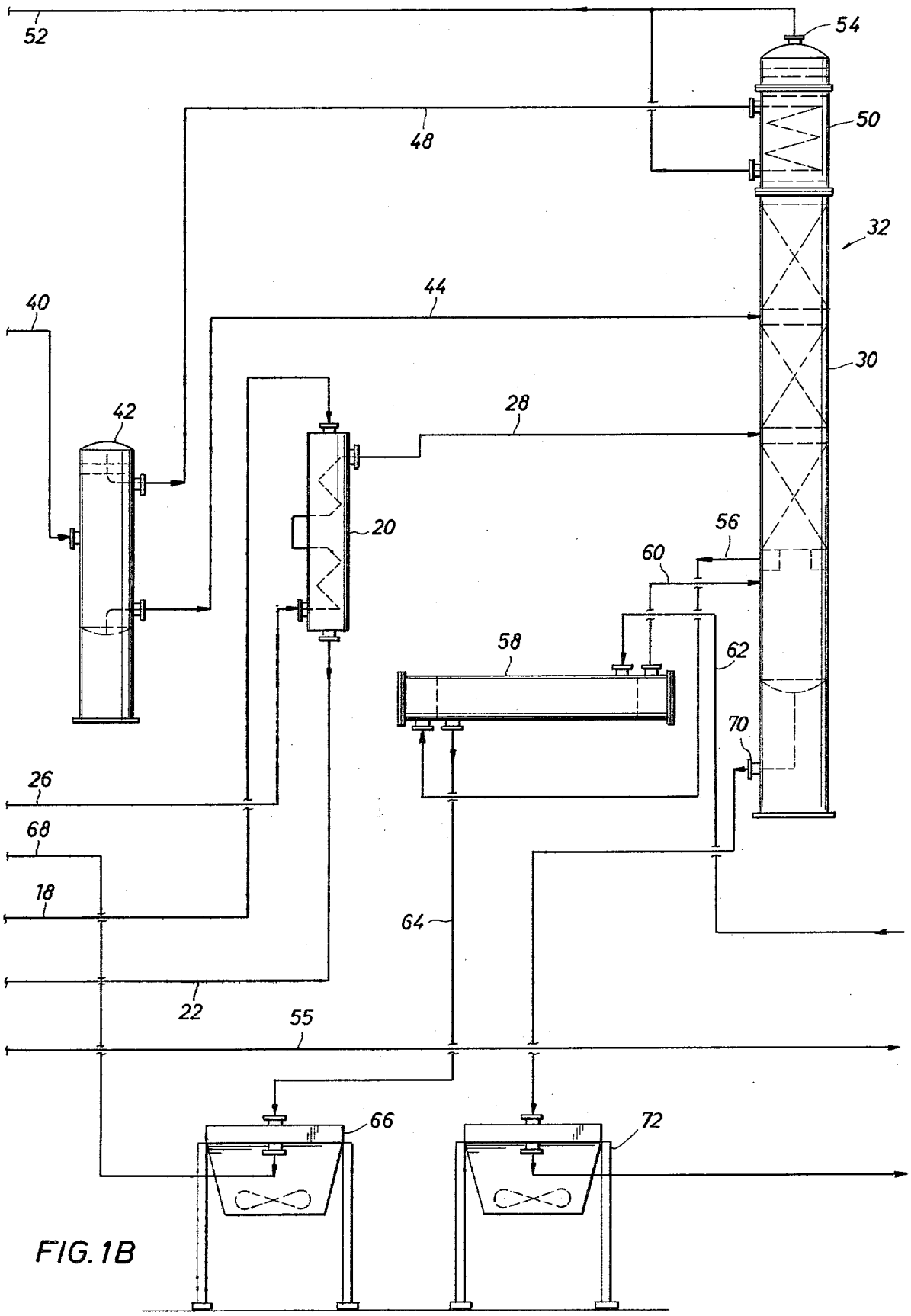

The process of the present invention as outlined in the flow sheet of FIG. 1 will be described with regard to the fractionation of hydrocarbon gas composed predominately of methane, such as natural gas. In addition to methane, the process contemplates that the inlet gas stream will also include quantities of the condensable components of ethane, propane, isobutane, butane, isopentane, pentane, hexane and heptane plus the heavier natural gasolines. In addition, quantities of helium, nitrogen and carbon dioxide will typically be present.

Although not directly forming a part of the process of the instant invention, an important condition precedent to the introduction of gas into a low temperature process is dehydration of the gas prior to entering the plant. Dehydration of natural gas prior to introduction to the plant may be performed by a dry bed desiccant system where the inlet gas is dehydrated to a relatively low dew point. The desiccant system may be of the molecular sieve type or something similar thereto which is capable of achieving the desired low water dew point, and preferably of the type which may be regenerated.

Referring now to the accompanying flow sheet, from the dehydrators, high pressure gas is fed to the plant through line 10 and passes through a gas-gas heat exchanger 12, wherein it is cooled to an appropriate temperature by exchange with residue gas to remove any heavy condensate which may be in the gas. From heat exchanger 12, the resulting condensate and gas flows through line 14 to a gas chiller 16 which further cools the gas-condensate mixture. Heat exchanger 12 and chiller 16 constitute the pre-cooling stage of the process.

The cooled gas-condensate mixture is flowed from chiller 16 through line 18 to gas-liquid heat exchanger 20. The mixture is further cooled to a temperature below 0° F. by exchange with a liquid separated from the gas-condensate mixture itself, as will be explained further hereinafter. The resulting low temperature gas and condensate leaves heat exchanger 20 through line 22 and is directed to cold separator 24.

Separator 24 is capable of phase separation of hydrocarbon condensate which is withdrawn as liquid through line 26 and flowed back to heat exchanger 20. The heat imparted to the liquid in passing through heat exchanger 20 effects a partial reboil of the methane and ethane in that stream. After passage through heat exchanger 20, the hydrocarbon condensate in the form of vapor and liquid is flowed through line 28 to an intermediate tray in stripping section 30 of a fractionating column, such as de-ethanizer 32. The vapor of the stream can then be utilized within the fractionating column to strip methane and ethane from incoming liquid streams above section 30.

Gas containing methane, ethane and propane is flowed from separator 24 through line 34 to a gas expander, such as expansion turbine 36, where the gas is expanded and thereby cooled even further. The work force developed in turbine 36 is used to drive a compressor 38 which is directly coupled to the expander.

The exhaust from turbine expander 36 is a gas-condensate mixture at an intermediate pressure and a low temperature. This mixture flows through line 40 to expander separator 42, wherein the liquid comprised of $C_1$, $C_2$ and $C_3$ hydrocarbons is removed through line 44 and flowed to a tray in section 46 of the de-ethanizer 32. The gas phase which is substantially pure methane and ethane at a temperature below −50° F. is flowed through line 48 to reflux condenser 50 disposed internally of de-ethanizer 32 at the upper end thereof to effect recovery of the propane and heavier constituents of the inlet gas stream as liquid product and reject the methane and ethane content.

The very cold methane and ethane gas from expander separator 42, as utilized in reflux condenser 50, provides the necessary refrigeration to effect low temperature separation of propane from ethane in the presence of methane. The additional refrigeration supplied by this technique causes purification of the liquid and liquid-vapor streams such that propane and the heavier hydrocarbons fall downwardly in the column as liquids and accumulate in the bottom of the column. Any methane or ethane existing in either the liquid from expander separator 42 or the liquid-vapor from heat exchanger 20 do not condense and are removed from the column through outlet 54 at the upper end thereof.

Accordingly, passage of the inlet gas through refrigeration zones followed by a first separation stage, an expansion of the resulting gas from the first separation, and a second stage of separation to provide a liquid of $C_1$–$C_3$ and some heavier hydrocarbons and a gas comprised substantially only of $C_1$ and $C_2$ hydrocarbons allows the fractionation of propane and heavier hydrocarbons to be carried out in a fractionation column at temperatures below about −50° F., as the $C_1$ and $C_2$ hydrocarbon gas is utilized in a reflux condenser to condense out the desired components and reject the ethane and methane.

De-ethanizer 32 is a conventional fractionating column having a plurality of vertically spaced liquid trays. The column has an outlet 54 in the upper end thereof above reflux condenser 50 for passing non-condensed gas to line 52. In addition, the column is provided with an outlet at the bottom for withdrawing the liquid product through line 70 to storage.

The gas from reflux condenser 50 is combined with the overhead vapor from outlet 54 in the de-ethanizer 32 to constitute the residue gas. The residue gas flows into line 52 and is passed through gas-gas heat exchanger 12 and is thereafter flowed through line 53 to compressor 38 which is driven by turbine expander 36. Compressor 38 compresses the gas and discharges it into line 55 which takes it to another compressor (not shown) prior to introduction into reboiler heat exchanger 58. After passage through reboiler exchanger 58, the recompressed residue gas is passed through a sales gas cooler 66 and made available from the outlet of line 68 as sales gas.

Condensed propane and heavier hydrocarbons removed from de-ethanizer 32 through line 56 are flowed through reboiler heat exchanger 58, returning to the column through line 60. Reboiler heat exchanger 58 heats the liquid by exchange with recompressed residue gas brought into heat exchanger 58 through line 62, and removed through line 64, to drive off any remaining methane and ethane.

In operation of the foregoing process with typical operating conditions, the inlet gas at line 10 may be at a pressure of between 600 and 1,000 psig and be at ambient temperature. The exact temperature will depend upon the particular location of the well and the prevailing weather conditions under which the gas stream is taken from the well. Typically, the inlet gas stream will contain approximately 94% methane, 2.5% ethane, 2% propane and heavier hydrocarbon components, and 1.5% combined carbon dioxide and nitrogen. The inlet gas stream enters gas-gas heat exchanger 12 at the ambient temperature and is cooled to a temperature of between +20° F. and −40° F. The stage of cooling through gas chiller 16 may or may not be required, depending upon how low the temperature of the gas is at ambient and also upon how lean the gas is. In any event, the gas-condensate stream entering gas-liquid heat exchanger 20 should be at a temperature of between +5° F. and −40° F. Upon leaving heat exchanger 20, the gas-liquid condensate should be at a temperature between 0° F. and −40° F.

Liquid leaving cold separator 24 is cooled to a temperature between −50° F. and −100° F. through expansion valve 27. Passage through gas-liquid heat exchanger results in a liquid vapor stream having a temperature between 0° F. and −30° F. The gas stream from cold separator 24 after expansion through turbane expander 36 is reduced in temperature to between −80° F. and −120° F. The pressure decrease is down to between 150 and 250 psig.

The gas stream from expander separator 42, which is comprised essentially of methane and ethane only, enters reflux condenser 50 at −80° F. to −120° F. and leaves the condenser at a temperature of between −45° F. and −65° F. The liquid from separator 42 is also between −80° F. and −120° F.

The residue gas that exits through outlet 54 at the top of de-ethanizer 32 is at a temperature of −50° F. to −70° F. The lower portion of the de-ethanizer column typically will be at a temperature between 120° F. and 170° F. and at a pressure of around 200 psig. Product taken from the outlet 70 at the lower end of the column will be at this temperature, but will be subsequently cooled through product cooler 72 back to approximately ambient temperature of the inlet gas.

Reboiler heat exchanger 58 receives the recompressed residue gas at a temperature of between 250° F.

and 300° F. and releases it at a temperature of between 120° F. and 140° F. The recompressed residue gas is thereafter cooled in sales gas cooler 66 down to the ambient temperature of the entering inlet gas stream.

It is to be understood that the foregoing is given as a typical operating range and the exact values will vary depending upon the exact constituency of the inlet gas stream which is to be processed.

For purposes of illustration and not as limiting values, for an inlet gas stream of natural gas containing 71% methane, 14% ethane, 8.5% propane and 3.5% to 4% heavier components and 1% to 2% combined carbon dioxide and nitrogen, the following conditions may exist. Inlet gas from the dehydrators will preferably be at a temperature of 100° F. and at a pressure of 900 psig. The outlet stream from gas-gas heat exchanger 12 will be at a temperature of 4° F., which will be further reduced in gas chiller 16 to a temperature of 1° F. Passage of the gas-condensate stream through gas-liquid heat exchanger 20 lowers the temperature further to a preferable value of −20° F. at a pressure of 870 psig. The expanded liquid from cold separator 24 will enter heat exchanger 20 at a temperature of −72° F. and will leave there and be introduced into the de-ethanizer column at a temperature of −25° F. The gas from cold separator 24 after expansion through turbine expander 36 will be at a temperature of −109° F. and a pressure of 205 psig. After passage of the gas available from expander separator 42 through reflux condensor 50, the temperature of the gas will be a −54° F. The residue gas that is rejected through outlet 54 will be at −60° F. The combined residue gas that reaches heat exchanger 12 will be at −56° F. and will be warmed to 90° F. after passage therethrough. Following recompression, the residue gas will be at a temperature of 263° F., but passage through de-ethanizer reboiler heat exchanger 58 will lower the temperature to 133° F. followed by further cooling to 100° F. by the sales gas cooler.

Preferably, the de-ethanizer column will have liquid and gas vapor at the lower end at a temperature of 138° F. and at a pressure of 200 psig. The liquid product, propane and the heavier hydrocarbons, will be drawn off at 138° F. but will be cooled in the product cooler to 100° F.

With the low temperature fractioning process just described, a propane recovery efficiency of 90% or greater can be achieved, with rejection of 90% or more of the ethane content of the inlet gas stream. Further, such recovery efficiency is obtained using but a single de-ethanizer column, and no additional refrigeration.

Although the above description is directed to the preferred embodiment of the invention and relates to the processing of natural gas to recover propane, it will be appreciated by those skilled in the art that the process and the apparatus for carrying out the process will admit to variations and modifications, and will be applicable to the processing of hydrocarbon gas other than natural gas and to the recovery of components other than propane, such as ethane.

What is claimed is:

1. A process for low temperature fractionation of dehydrated natural gas to remove propane and heavier hydrocarbon components therefrom and reject methane and ethane, comprising the steps of:

cooling the inlet natural gas to produce a first gas-condensate mixture;

separating the gas phase and the hydrocarbon condensate of said first gas-condensate mixture;

heating the hydrocarbon condensate of the first gas-condensate mixture to effect at least a partial reboil thereof to produce a liquid-vapor stream;

expanding the gas phase of said first gas-condensate mixture through a turbine to produce a second gas-condensate mixture;

separating the gas phase and the hydrocarbon condensate of said second gas-condensate mixture;

flowing the hydrocarbon condensate of said second gas-condensate mixture to a fractionating column;

flowing said liquid-vapor stream to said fractionating column to strip methane and ethane from the hydrocarbon condensate of said second gas-condensate mixture;

flowing the gas phase of said second gas condensate mixture to a reflux condenser inside said fractionating column; and condensing hydrocarbon components of said inlet gas with said reflux condenser providing the necessary refrigeration for recovering propane as the liquid product and rejecting the ethane.

2. The process of claim 1 further comprising the steps of:

withdrawing the liquid product from said column and heating it to a temperature to expel methane and ethane vapor therefrom; and returning said heated liquid product and said vapor to said column.

3. The process of claim 1 wherein cooling of the inlet gas is by passage through refrigeration zones in the form of heat exchangers.

4. The process of claim 1 including the steps of:

heat exchanging the rejected gas from the reflux condenser with inlet gas to cool said inlet gas; and recompressing said rejected gas after heat exchanging and utilizing said rejected gas to heat liquid from said column to expel methane and ethane vapor therefrom.

5. The process of claim 1 wherein the gas phase of the second gas-condensate mixture consists essentially of $C_1$ and $C_2$ hydrocarbons and the hydrocarbon condensate of the second gas-condensate mixture comprises $C_1$, $C_2$ and $C_3$ hydrocarbons.

6. Apparatus for recovering condensable components from hydrocarbon gas comprising:

first and second heat exchangers for cooling gas passed therethrough to produce a gas-condensate mixture;

a first separator for phase separation of the gas and the hydrocarbon condensate;

a gas expander for cooling the gas phase to produce a low temperature gas-condensate mixture;

a second separator for phase separation of the gas and the hydrocarbon condensate of the low temperature mixture; and a fractionating column receiving the hydrocarbon condensate from said second separator at a point intermediate the upper and lower ends, said column having a reflux condenser at the upper end for receiving the low temperature gas from said second separator and providing the necessary refrigeration for recovering propane in the liquid product and rejecting the ethane;

said first heat exchanger is a gas-gas heat exchanger, heat exchanging inlet gas with rejected gas from said fractionating column;

said second heat exchanger is a gas-liquid heat exchanger, heat exchanging inlet gas with hydrocarbon condensate from said first separator.

7. The apparatus of claim 6 wherein said gas expander is a turbine.

8. The apparatus of claim 6 including a reboiler heat exchanger receiving liquid withdrawn from said column and heat exchanging therewith compressed rejected gas from said second heat exchanger.

* * * * *